US008540072B2

(12) United States Patent
Rospek et al.

(10) Patent No.: US 8,540,072 B2
(45) **Date of Patent: *Sep. 24, 2013**

(54) PACKAGING SYSTEM FOR DETONATING CORDS FOR X-RAY EXAMINATION AND SAFE SHIPPING

(75) Inventors: Rolf Rospek, Edemissen (DE); Malte Veehmayer, Siegbürg (DE); Dimitri Riesen, Troisdorf (DE)

(73) Assignee: Dynaenergetics GmbH & Co. KG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/210,832

(22) Filed: Aug. 16, 2011

(65) Prior Publication Data

US 2011/0297570 A1 Dec. 8, 2011

Related U.S. Application Data

(62) Division of application No. 10/554,245, filed as application No. PCT/EP2004/003907 on Apr. 14, 2004, now Pat. No. 8,009,801.

(30) Foreign Application Priority Data

Apr. 25, 2003 (DE) ..... 103 18 996

(51) Int. Cl.
*F42B 39/30* (2006.01)

(52) U.S. Cl.
USPC ..... 206/3; 206/524.8

(58) Field of Classification Search
USPC ..... 206/3, 303, 388, 495, 524.8, 466, 206/49, 702; 53/430
See application file for complete search history.

(56) References Cited

U.S. PATENT DOCUMENTS

| | | | | |
|---|---|---|---|---|
| 1,516,137 | A | 11/1924 | Berstein | |
| 2,393,221 | A | 1/1946 | Mercer et al. | |
| 3,396,835 | A * | 8/1968 | Boutonnet | 206/410 |
| 3,490,192 | A | 1/1970 | Regan, Jr. | |
| 3,537,226 | A * | 11/1970 | Le Van et al. | 53/430 |
| 3,633,758 | A * | 1/1972 | Morse et al. | 211/85.13 |
| 3,780,854 | A * | 12/1973 | Ruppenthal | 206/499 |
| 3,815,315 | A * | 6/1974 | Glick | 53/425 |
| 4,135,622 | A * | 1/1979 | Glick | 206/63.3 |
| 4,262,800 | A * | 4/1981 | Nethercutt | 206/364 |
| 4,411,364 | A | 10/1983 | Friedman | |
| 4,425,406 | A * | 1/1984 | Palma | 428/12 |

(Continued)

FOREIGN PATENT DOCUMENTS

| | | |
|---|---|---|
| DE | 32 26 744 A1 | 3/1983 |
| EP | 0 382 615 B1 | 8/1990 |
| RU | 2 123 684 C1 | 12/1998 |
| WO | WO 99/00636 | 1/1999 |

OTHER PUBLICATIONS

Automated Translation of DE 32 26 744 from European Patent Office, Mar. 23, 2010.

*Primary Examiner* — David Fidei

(57) ABSTRACT

The invention relates to a packaging for a detonation cord that is used especially for igniting shaped charged perforators in perforation guns utilized in the oil and natural gas industry. According to the invention, the detonation cord is wound on one plane as a flat coil. Also disclosed is a method for examining whether a detonation cord has faulty points. Said method is characterized in that the detonation cord is subjected to an x-ray examination in the packaging before being delivered.

5 Claims, 2 Drawing Sheets

(56) References Cited

U.S. PATENT DOCUMENTS

| | | | | | |
|---|---|---|---|---|---|
| 4,586,602 | A | | 5/1986 | Levey | |
| 4,688,674 | A | * | 8/1987 | Stirtz | 206/388 |
| 4,817,787 | A | | 4/1989 | Owen | |
| 4,972,946 | A | * | 11/1990 | Whittaker | 206/210 |
| 5,005,694 | A | * | 4/1991 | Davis et al. | 206/3 |
| 5,007,230 | A | * | 4/1991 | Gaston | 53/397 |
| 5,114,662 | A | | 5/1992 | Gozani et al. | |
| 5,129,514 | A | * | 7/1992 | Lilley, Jr. | 206/388 |
| 5,526,928 | A | * | 6/1996 | Yabe et al. | 206/364 |
| 5,620,098 | A | | 4/1997 | Boos et al. | |
| 5,669,490 | A | | 9/1997 | Colligan et al. | |
| 5,695,456 | A | | 12/1997 | Cartmell et al. | |
| 5,704,473 | A | | 1/1998 | Oster | |
| 6,053,313 | A | * | 4/2000 | Farrell et al. | 206/364 |
| 6,062,236 | A | * | 5/2000 | Gaudet | 132/321 |
| 6,237,768 | B1 | * | 5/2001 | Cipriani | 206/408 |
| 6,520,325 | B1 | * | 2/2003 | Simpson | 206/303 |
| 6,610,977 | B2 | | 8/2003 | Megerle | |
| 6,702,118 | B2 | * | 3/2004 | O'Connor et al. | 206/494 |
| 7,410,049 | B2 | | 8/2008 | O'Brien et al. | |
| 8,009,801 | B2 | * | 8/2011 | Rospek et al. | 378/57 |
| 2001/0013479 | A1 | * | 8/2001 | Giancarlo | 206/408 |
| 2004/0187438 | A1 | * | 9/2004 | Clarke et al. | 53/400 |
| 2006/0260967 | A1 | * | 11/2006 | Clarke et al. | 206/438 |

* cited by examiner 1
2
4
7

PACKAGING SYSTEM FOR DETONATING CORDS FOR X-RAY EXAMINATION AND SAFE SHIPPING

CROSS-REFERENCE TO RELATED APPLICATION

This application is a divisional application of application Ser. No. 10/554,245, filed Oct. 25, 2005, the disclosure of which is hereby incorporated by reference.

BACKGROUND OF THE INVENTION

The invention relates to packaging for a detonating cord and a method of examining a detonating cord in its packaging.

Detonating cords are used to fire shaped charge perforators in perforating guns in the oil and natural gas industry. To ensure error-free initiation of charges, a defect-free detonating cord is needed. Incomplete detonation caused by inadequate filling of the detonating cord with explosive material may in particular lead to costly delays.

To enable these detonating cords to be shipped by sea, land or air, special packaging is required, the requirements for which are regulated by law. Packaging is described, for example in EP 0 382 615 BI, U.S. Pat. Nos. 4,586,602 or 4,817,787.

BRIEF SUMMARY OF THE INVENTION

The object of the invention is to provide packaging for detonating cords which meets legal requirements and to provide a method with which the detonating cord may be examined in its packaging for defects.

The method according to the invention is distinguished in that the detonating cord is subjected to X-ray examination in its packaging prior to shipping. An X-ray examination makes it easy to detect defects caused for example by inadequate filling with explosive material.

Packaging according to the invention is characterised in that the detonating cord is wound in a single plane as a flat spiral.

In an advantageous embodiment, the individual laps of the spiral are spaced from one another. The space is preferably filled with air or material, e.g. by spacers or by a spacing cord extending in parallel, wherein the thickness of the spacing cord corresponds to the necessary space.

The space between the laps ensures that, in the event of misfiring of the detonating cord, the adjacent lap is destroyed without crossover firing. Crossover firing means that the adjacent lap is ignited and the ignition process passed on to the remaining laps.

Advantageously, the last lap is passed perpendicularly over the flat-wound spiral.

In a preferred embodiment, the base plate of the packing consists of paperboard, wood or polystyrene.

The detonating cord is preferably sealed in a vacuum bag, which is attached to the base plate.

BRIEF DESCRIPTION OF THE DRAWINGS

The invention is explained in more detail below with reference to two Figures.

DETAILED DESCRIPTION OF THE INVENTION

Figure 2:
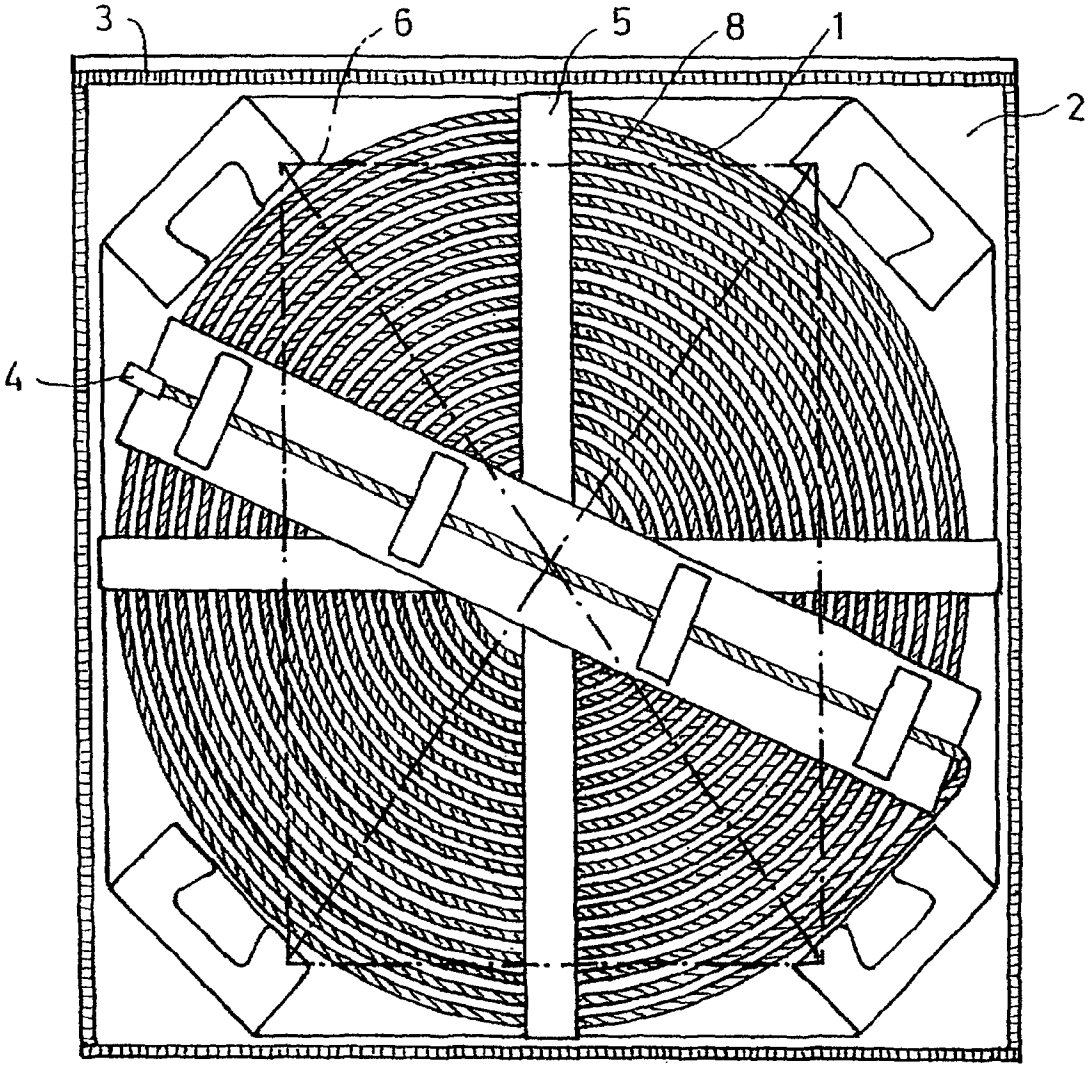
FIG. 2 shows a packaging system according to the invention for a detonating cord.

FIG. 2 shows a packaging system according to the invention for a detonating cord 1. The detonating cord 1 is wound as a flat spiral, the two ends being provided with an end cap 4. The base plate 2 of the packaging may consist, for example, of paperboard, wood or polystyrene. In the embodiment illustrated here, the detonating cord 1 is attached to the base plate 2 via a vacuum bag 3. This means that the detonating cord 1 is sealed in a plastics bag, which is in turn attached to the base plate 2. One lap of detonating cord 1 is passed perpendicularly over the flat-wound spiral.

Adhesive strips 5 adhering in the shape of a cross to 30 the detonating cord 1 serve to fix the detonating cord 1 prior to sealing in the vacuum bag 3. The individual laps of the spirally wound detonating cord 1 are arranged at a given spacing from one another, so that, in the event of misfiring of the detonating cord 1, the adjacent lap is destroyed without crossover firing taking place. Crossover firing means that the adjacent lap is ignited and the ignition process passed on to the remaining laps. In FIG. 2, the space is produced by a spacing cord 8 extending in parallel.

Reference numeral 6 indicates the image area of an X-ray installation, wherein the entire detonating cord 1 is advantageously X-rayed at once. The X-ray image is preferably taken at a right angle to the plane of the spiral detonating cord. If a booster is connected to the detonating cord 1, the wad gaps between booster and detonating cord 1 may likewise be inspected by X-ray image.

Figure 1:
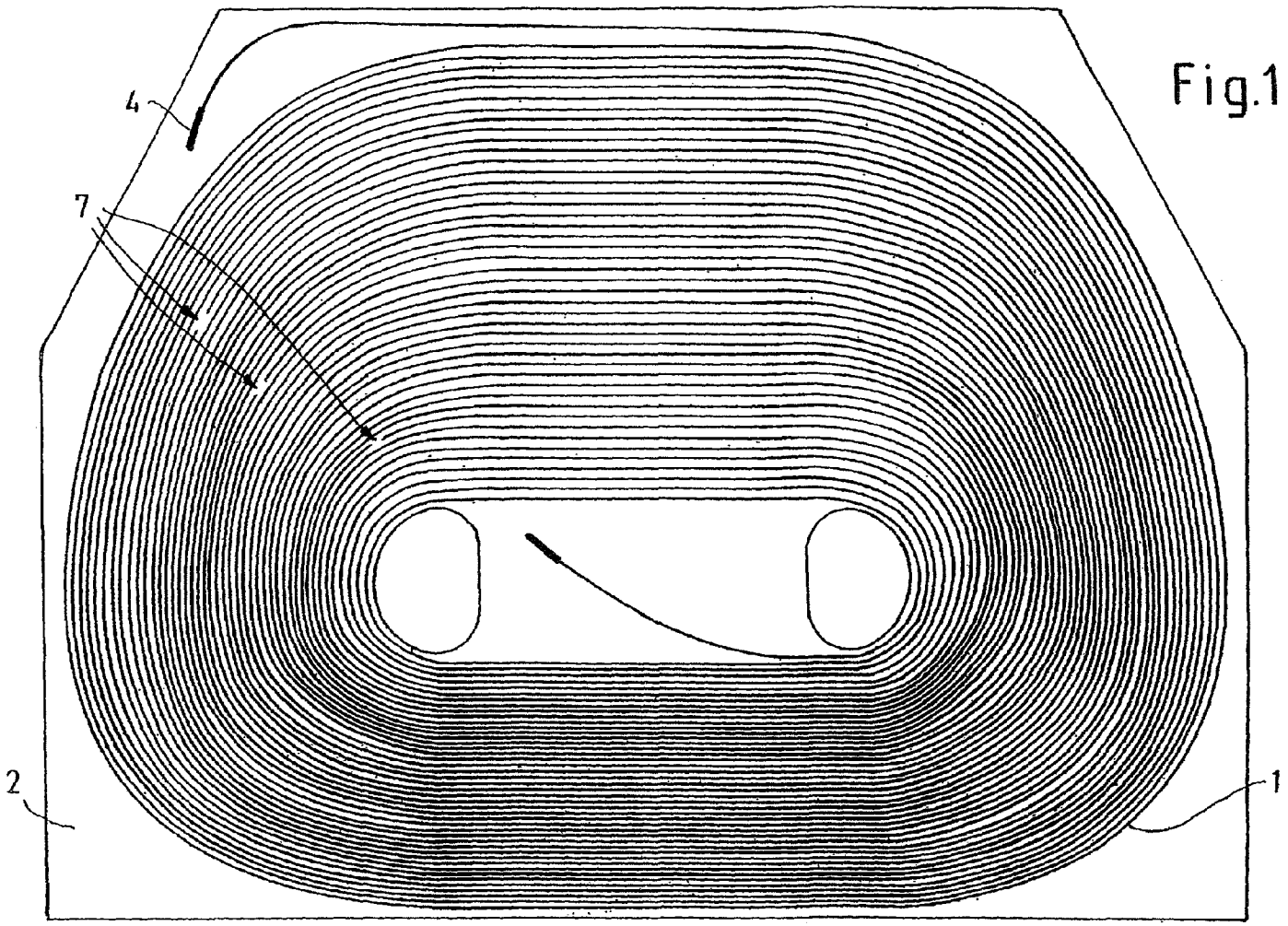
FIG. 1 shows an X-ray image of a spiral detonating cord in its packaging.

FIG. 1 shows such an X-ray image of the spiral detonating cord 1 in its packaging. In this illustrated instance, the detonating cord 1 contains defects 7, however, which would lead to failure of the detonating cord 1. This defective detonating cord 1 would therefore not be shipped.

The invention claimed is:

1. A detonating cord apparatus used to ignite a shaped charge perforator in a perforating gun in the oil and natural gas industry, comprising:

a detonating cord wound in a single plane into a flat spiral, in such a manner so as to enable the detonating cord to be subjected to X-ray examination without unwinding the detonating cord, thereby enabling a determination of whether the detonating cord contains or does not contain a type of defect known to lead to failure of the detonating cord;

a spacing cord in contact with and extending in parallel to the detonating cord;

wherein the detonating cord and the spacing cord in contact with and extending in parallel to the detonating cord are wound together in a single plane into a flat spiral, and wherein the spacing cord separates, at least in part, at least two individual laps of the wound detonating cord from one another;

a packaging enveloping the detonating cord; and a base plate, upon which the detonating cord is wound, wherein the packaging includes a vacuum bag, within which the detonating cord is disposed, and wherein the vacuum bag is attached to the base plate.

2. A detonating cord apparatus used to ignite a shaped charge perforator in a perforating gun in the oil and natural gas industry, comprising:

a detonating cord wound in a single plane into a flat spiral, in such a manner so as to enable the detonating cord to be subjected to X-ray examination without unwinding the detonating cord, thereby enabling a determination of whether the detonating cord contains or does not contain a type of defect known to lead to failure of the detonating cord;

a spacing cord in contact with and extending in parallel to the detonating cord;

wherein the detonating cord and the spacing cord in contact with and extending in parallel to the detonating cord are wound together in a single plane into a flat spiral, and wherein the spacing cord separates, at least in part, at least two individual laps of the wound detonating cord from one another;

a packaging enveloping the detonation cord; and a base plate, upon which the packaging enveloping the detonating cord is disposed, wherein the packaging includes a vacuum bag, within which the detonating cord and the spacing cord are disposed, and wherein the vacuum bag is attached to the base plate.

3. The detonating cord apparatus according to claim 1, wherein the vacuum bag is sealed.

4. The detonating cord apparatus according to claim 2, wherein the vacuum bag is sealed.

5. A detonating cord apparatus used to ignite a shaped charge perforator in a perforating gun in the oil and natural gas industry, comprising:

a detonating cord wound in a single plane into a flat spiral, in such a manner so as to enable the detonating cord to be subjected to X-ray examination while in its packaging, and without unwinding the detonating cord, thereby enabling a determination of whether the detonating cord contains or does not contain a type of defect known to lead to failure of the detonating cord;

a spacing cord in contact with and extending in parallel to the detonating cord;

a base plate, upon which the detonating cord is wound, comprising at least one of paperboard, wood and polystyrene; and a packaging enveloping the detonating cord;

wherein the detonating cord and the spacing cord in contact with and extending in parallel to the detonating cord are wound together in a single plane into a flat spiral; and wherein the spacing cord separates, at least in part, at least two individual laps of the wound detonating cord from one another;

wherein the packaging includes a vacuum bag, within which the detonating cord is disposed; and wherein the vacuum bag is attached to the base plate.

* * * * *

UNITED STATES PATENT AND TRADEMARK OFFICE

CERTIFICATE OF CORRECTION

PATENT NO. : 8,540,072 B2
APPLICATION NO. : 13/210832
DATED : September 24, 2013
INVENTOR(S) : Rolf Rospek, Malte Veehmayer and Dimitri Riesen It is certified that error appears in the above-identified patent and that said Letters Patent is hereby corrected as shown below:

On the Title Page, at Item (30) "Foreign Application Priority Data", insert -- Mar. 26, 2004 (DE) 10 2004 014 769.8 --

Signed and Sealed this
Second Day of December, 2014

Michelle K. Lee

Michelle K. Lee
*Deputy Director of the United States Patent and Trademark Office*